US005810260A

United States Patent [19]

Thomas

[11] Patent Number: 5,810,260

[45] Date of Patent: Sep. 22, 1998

[54] LIQUID DISTRIBUTORS

[75] Inventor: Neale Thomas, Selly Oak, Great Britain

[73] Assignee: Flow Research Evaluation Diagnostics Limited, Birmingham, Great Britain

[21] Appl. No.: 696,965

[22] PCT Filed: Feb. 27, 1995

[86] PCT No.: PCT/GB95/00408

§ 371 Date: Sep. 26, 1996

§ 102(e) Date: Sep. 26, 1996

[87] PCT Pub. No.: WO95/23030

PCT Pub. Date: Aug. 31, 1995

[30] Foreign Application Priority Data

Feb. 25, 1994 [GB] United Kingdom ..... 9403702

[51] Int. Cl.[6] ..... B05B 7/04

[52] U.S. Cl. ..... 239/426; 239/418; 239/429; 239/434

[58] Field of Search ..... 239/398, 418, 239/426, 429, 433, 434, 690, 704

[56] References Cited

U.S. PATENT DOCUMENTS

| | | | |
|---|---|---|---|
| 2,788,719 | 4/1957 | Bennett | 239/431 X |
| 3,047,208 | 7/1962 | Coanda | 239/DIG. 7 X |
| 3,114,654 | 12/1963 | Nishiyama et al. | 239/704 X |
| 3,215,415 | 11/1965 | Stephens et al. | 239/431 X |
| 3,899,130 | 8/1975 | Bell, Jr. | 239/418 |
| 4,508,273 | 4/1985 | Firey | 239/433 X |
| 4,558,822 | 12/1985 | Nieuwkamp et al. | 239/DIG. 7 X |
| 5,261,611 | 11/1993 | Huxford | 239/690 |

*Primary Examiner*—Andres Kashnikow
*Assistant Examiner*—Robin O. Evans
*Attorney, Agent, or Firm*—Young & Thompson

[57] ABSTRACT

A spray generator has a gas duct (1, 6, 10, 14, 16, 21) from which issues a stream of gas in various configurations according to the shape of the delivery end. Liquid is directed by nozzles (3, 11) or other means (13, 18, 22) transversely into the gas stream, although it may have a directional component going with that stream and/or a component to generate swirl. The relative speeds and amounts of gas and liquid cause the liquid to break up into droplets (9, 24) which form discrete clusters (5, 8) in a compact spray pattern. Secondary gas streams (17, 23) can be applied further to shape the spray pattern.

3 Claims, 3 Drawing Sheets

LIQUID DISTRIBUTORS

Figure 1:
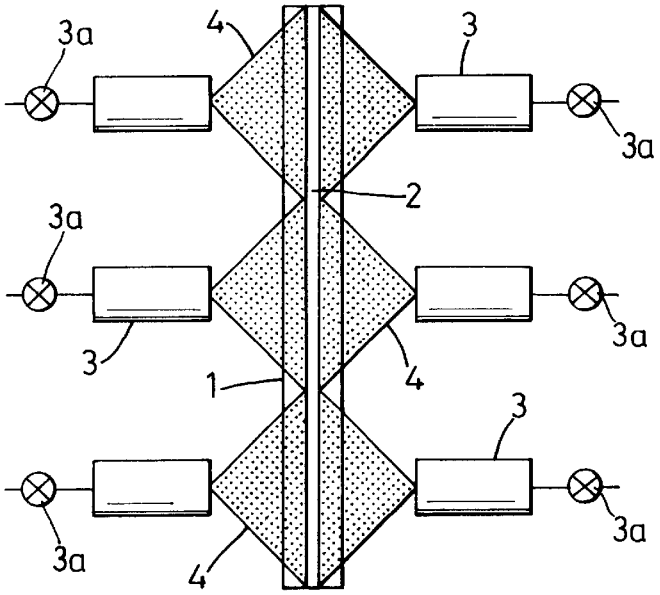

This invention relates to liquid distributors, and is primarily concerned with spray generators.

In this Specification, reference will often be made to air and water, since experiments to date have been conducted with them. But it should be understood that air, although the most common medium, may be replaced by other gas, or mixed with it, and water will generally be replaced by or dilute other liquid, including surfactant material.

Liquid sprays are used in a great number of fields, and while this invention has been developed first with an eye on agricultural spraying, clearly it could have many other applications, some of which will be mentioned later.

With many sprays, one wants very fine droplets to disperse as evenly as possible. But the finer they are, the more likely they are to drift and blow away. In agricultural spraying, conditions have to be very carefully chosen, but even so it has been estimated that perhaps only 30% of what is sprayed typically settles on target. This represents not only enormous waste, but also a considerable hazard, since some of the other 70% ends up in peoples' lungs or on their skin, and on vegetation or ground which may be harmed rather than helped by the spray liquid.

One way to keep a spray jet together is to project it at high speed. While that is acceptable for a few applications, it does not do for crop spraying and most other jobs. Not only does it demand considerable extra energy, but droplets travelling at high speed can damage tender crops or bounce off rather than settle.

The aim behind this invention was to provide a spray of moderate speed that can be composed of very fine droplets and yet which will keep together for a substantial throw. It should therefore be possible to control and direct it much better than most current sprays. But in conducting experiments it was also realized that other patterns of liquid distribution could be achieved.

According to the present invention, there is, provided a liquid distributor comprising a gas duct with a delivery end and means for projecting a substantially continuous stream of liquid into conjunction with the gas stream from the duct to direct and re-shape the liquid pattern.

With suitable relative velocities and sizes and shapes of apertures through which the air and water flow, it has been found that this can break up the water into extremely fine droplets and project them a considerable distance in the direction of the airstream in remarkably close confinement.

The projecting means preferably create the liquid stream symmetrical with respect to the gas stream. The projecting means can be arranged so that the liquid stream has a directional component transverse to the gas stream, parallel to the gas stream, and/or skew to the gas stream to create a swirl.

In one preferred form the delivery end is a slot to create a curtain of gas. This may be of substantially circular section, the liquid stream being at least mainly radially inwards towards the gas stream.

In another useful form the delivery end forms a gas stream of closed loop section, and at least some of the liquid stream will be at least mainly inwards towards the loop. But there could be a component of the liquid stream radially outwards from within the loop.

The gas duct can provide an additional, different speed gas stream co-axial within the first gas stream of annular section, and the different speed will preferably be higher than the speed of the first gas stream.

In a further arrangement, there are means for issuing another gas stream in a configuration to shroud the liquid pattern formed by the first gas stream and the liquid stream.

Preferably the projecting means deliver the liquid stream at a speed and in a quantity such that the gas stream breaks the liquid stream into droplets, thereby forming a spray generator. Furthermore, the relationship between the streams can be such that the droplets tend to cohere in clusters. Even though both flows are uniform, it has been demonstrated that, when they combine, a pulse characteristic is developed, and the spray consists of a series of densely packed clusters of droplets, which disperse and expand slightly as they go further from the air duct, separated by much less dense droplet zones. It is believed that it is this close packing of droplets into clusters, that keeps the spray within bounds.

To assist spray generation the liquid projecting means may be adapted to break up the water before and as it issues as a liquid stream. For example there could be ribs over which the water must flow. These might be transverse to the flow to create turbulence, or aligned with it to "comb" the water into variable thicknesses. Also there could be means for introducing liquid into the gas stream before that issues from the duct and/or means for mixing gas with the liquid before that is projected into the air stream.

For non-spray applications, the gas stream may be downwards and the projecting means arranged to deliver the liquid stream at a speed and in a quantity such that the gas stream maintains the liquid stream as a curtain over a substantial distance.

In another arrangement the gas stream is downwards and within a predominantly downwards liquid stream, the relationship between the streams being such that hollow drops are formed and detach from the liquid stream.

The gas and liquid streams may have a substantially even speed, although there could be means for adjusting the speed of at least one stream. Alternatively, there may be means for pulsing at least one stream. This might be done actively, for example by using piezo electric vibration in the ducting. Alternatively, it might be done passively, by suitably resonant cavities in the ducting.

An electro-static charge could also be applied to the liquid stream.

Figure 2:
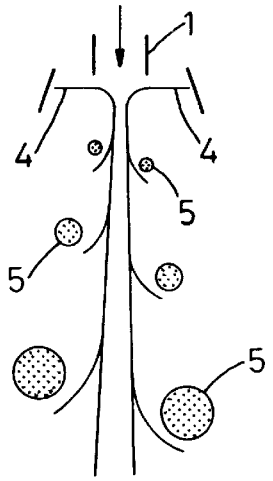
Figure 3:
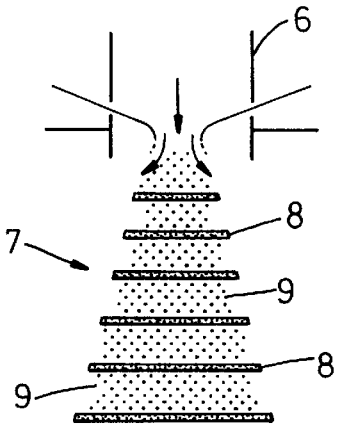
Figure 4:
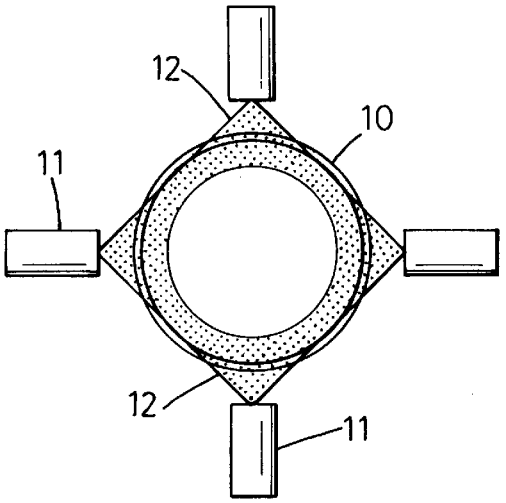
Figure 5:
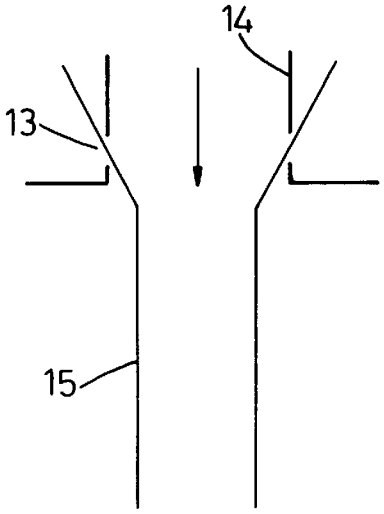
Figure 6:
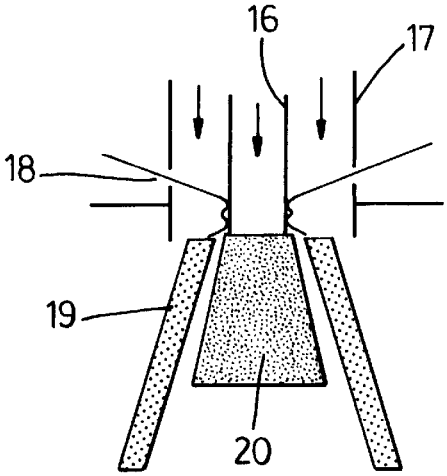
Figure 7:
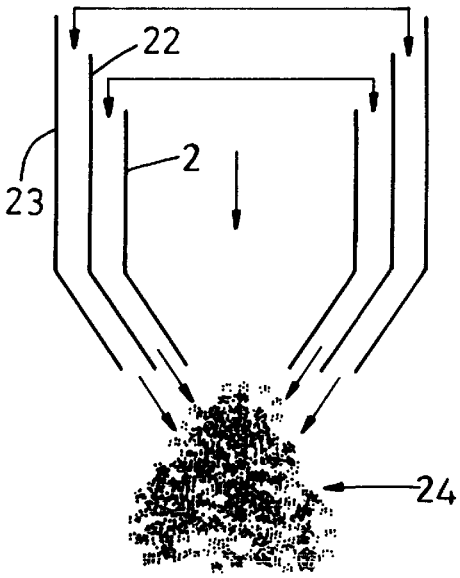
Figure 8:
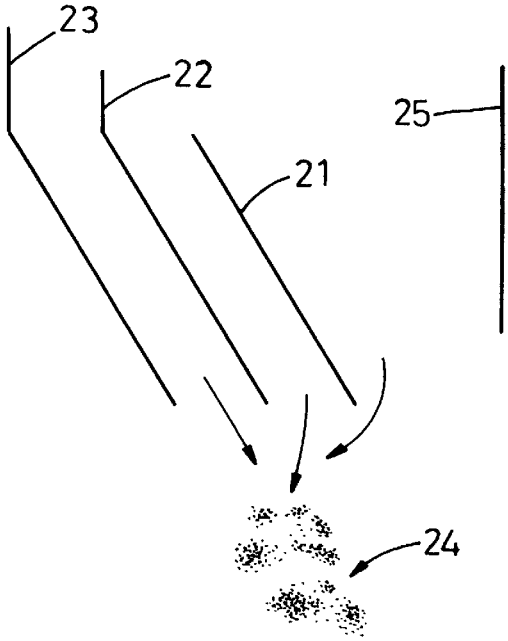
Figure 9:
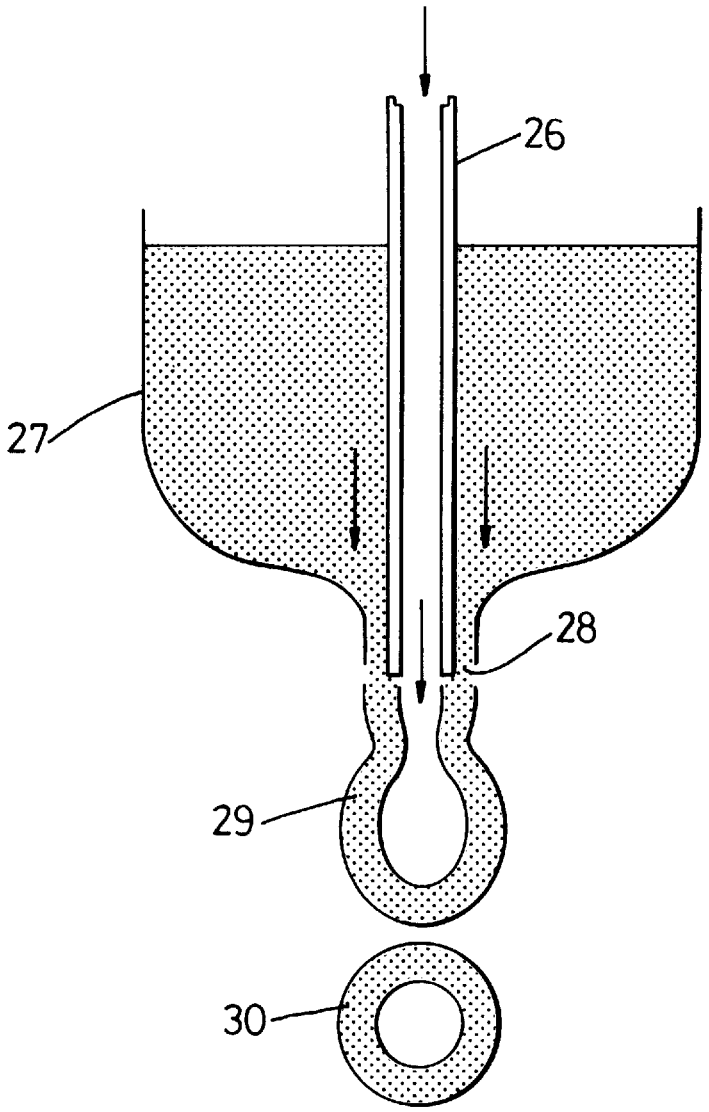

For a better understanding of the invention, some embodiments will now be described, by way of example, with reference to the accompanying drawings, in which all the figures are diagrammatic and in which:

FIG. 1 is a bottom view of a spray generator for producing a generally flat spray curtain, FIG. 2 is an end view of the spray generator of FIG. 1, FIG. 3 is a side view of a spray generator for producing a narrow conical spray pattern, FIG. 4 is a bottom view for producing a hybrid spray pattern, FIG. 5 is a side view of a generator for producing a thin walled liquid cylinder rather than a spray, FIG. 6 is a side view of a spray generator for producing a spray cone with differentially sized drops, FIG. 7 is a side view of a composite nozzle, FIG. 8 is a detail of FIG. 7 to illustrate atomisation, and FIG. 9 is a side view of a generator for producing hollow liquid droplets.

In FIGS. 1 and 2, an air duct 1 terminates at its lower end in an elongate slot 2 of uniform width. Ranged along opposite sides of this slot, just below it, there are flat fan nozzles 3 pointing horizontally across the length of the slot. In this example, there are three on each side, and they are paired off directly to oppose each other. When water is supplied under pressure to the nozzles 3, it issues in flat fans 4, the spacing of the nozzles being such that adjacent fans just meet before passing under the slot 2.

The speed of at least one stream in the form of a flat fan 4 can be adjusted at least one valve 3*a* in the supply lines to the nozzles 3.

Air directed downwards through the slot 2 turns the opposed sheets of water downwards as illustrated in FIG. 2. The interaction breaks up the water into fine droplets, but they tend to develop into densely packed clusters 5, evenly spaced, but asymmetric on opposite sides of the vertical center plane. The frequency of these clusters is generally in the range 100 to 1000 Hz. As the spray curtain develops, these clusters expand, but remain coherent for a substantial distance. There are droplets dispersed between them, but at substantially less concentration. By virtue of the fast moving central airflow, the spray curtain remains confined within a narrow angle typically (10°–20°) for a considerable distance from the slot 2.

Referring to FIG. 3, instead of an elongate slot, the air is delivered from a cylindrical duct 6. At its delivery end, water is injected into it at uniformly spaced points around its circumference or in a continuous annular sheet. As illustrated here, instead of being perpendicular to the axis of the duct, it is injected at a slant with a small component going with the airstream. This produces a narrow angled conical spray pattern 7 with evenly spaced ring clusters 8 developing, and with much more diffused drops 9 between them.

FIG. 4 shows a spray generator which is a hybrid of those described. The slot is developed into an annular opening 10 which produces an annular air jet. There are flat fan nozzles 11 evenly distributed around this and pointing towards the centre. Four nozzles are illustrated, but there could be more to the extreme of having a continuous annular sheet of water projected inwards. The liquid sheets 12 will impinge on the outside of the annular airstream, and be turned down and developed into an axisymmetric spray pattern with pulsing characteristics.

FIG. 5 is similar in many respects to FIG. 3, but here the liquid is projected at 13 into the delivery end of a cylindrical duct 14 at a very much more pronounced angle. Its major velocity component is parallel to the air flow. This does not produce droplets, but a long, thin-walled liquid cylinder 15. Obviously this does not have spray applications, but it may prove useful in other spheres. For example, the liquid could be plastic material that would be capable of changing from its liquid to its solid phase while dropping through a distance of one or two meters. A cheap pipe extrusion could thus be formed. Another possible use is in decoration, where a tube of water or other liquid, illuminated and subject to external disturbances could create an attractive feature.

In FIG. 6 there are two air ducts 16 and 17 co-axially one within the other. The air flow in the inner duct 16 is faster than that in the outer duct 17. The water is directed inwardly at 18 into the outer duct 17 either horizontally or at a slight angle, as shown, upstream of the delivery end of the inner duct 16. The water hitting the inner duct 16 sets up an oscillation, and it develops into an outer spray cone 19 of relatively coarse droplets and an inner spray cone 20 of finely atomized ones. The expansion half angle is generally in the range 5° to 15°, while the periodic spray structure (not illustrated) may be in the range 1000 to 2000 Hz.

Another possible configuration is shown in FIG. 7 in which there are three co-axial ducts 21, 22 and 23 converging inwards at their lower ends to concentrate the flow. The inner duct 21 delivers air, or possibly air pre-mixed with water, the intermediate duct 22 will carry water possibly pre-mixed with air, while the outer duct 23 will convey air only. The resultant atomised spray is indicated at 24. The interaction of these three fluid flows is illustrated in FIG. 8, where the axis of symmetry is indicated at 25. The faster flowing inner air stream expands and forces the liquid in the intermediate stream into the outer airstream, and this enhances atomisation.

In the embodiments described where the water is directed radially, this could be adjusted so that there is a component tangential to the air stream, thus creating a swirl.

Referring to FIG. 9, an air duct 26 passes centrally down through a liquid reservoir 27 and at its lower, delivery end forms an annular outlet 28 for the liquid. As this passes out of the outlet 28, air issuing from the duct 26 forms it into a lozenge 29 which breaks off periodically to form a hollow sphere or bubble 30. As the break-off occurs, the fluid below the duct 26 coalesces to start the next lozenge.

The spray nozzles described above and others following similar principles may have many different applications beyond agricultural spraying. For example they could be used for:

paint spraying/spray coating
fire fighting
artificial snow generation
fuel injector
foam generation
spray cooling
powdered metal creation
aeration
gas scrubbing
particle coating and encapsulation
emulsion creation
industrial washing
spray drying
spray reactors Experiments are still being conducted to determine optimum air and water velocities and volumetric flow rates. But satisfactory results have been achieved with water velocities from available fan nozzles of the order of 10 m/s and somewhat less from an annular nozzle, while the air velocity may be in the range 20 to 50 m/s. The volumetric flow rate of the air should be small (i.e. narrow slots used), balanced between the need to have sufficient to break up the liquid sheet(s) into droplets and to avoid a detrimental effect on whatever is being sprayed.

I claim:

1. A spray generator comprising a gas duct (1, 6, 10, 16, 17, 21) with a delivery end (2, 10) and means (3, 11, 22) for projecting a substantially continuous stream (4, 12, 5 18) of liquid in a symmetrically opposed manner transversely and inwardly into conjunction with the gas stream issuing from said duct at a speed and in a quantity such that the gas stream breaks the liquid stream into a spray of droplets (7, 19, 20, 24) following the direction of the gas stream, characterised in that the liquid stream is in sheet form and the meeting of the gas and liquid sheet creates droplets which tend to cohere into clusters (5, 8).

2. A spray generator as claimed in claim 1, characterised in that the gas and liquid streams have a substantially even speed.

3. A spray generator as claimed in claim 1, characterised in that there are means for adjusting the speed of at least one stream.

* * * * *